US010468239B1

(12) United States Patent
Steiner et al.

(10) Patent No.: US 10,468,239 B1
(45) Date of Patent: Nov. 5, 2019

(54) MASS SPECTROMETER HAVING MULTI-DYNODE MULTIPLIER(S) OF HIGH DYNAMIC RANGE OPERATION

(71) Applicant: Bruker Daltonics, Inc., Billerica, MA (US)

(72) Inventors: Urs Steiner, Aarau (CH); Felician Muntean, Andover, MA (US)

( * ) Notice: Subject to any disclaimer, the term of this patent is extended or adjusted under 35 U.S.C. 154(b) by 0 days.

(21) Appl. No.: 15/978,816

(22) Filed: May 14, 2018

(51) Int. Cl.
*H01J 49/26* (2006.01)
*H01J 49/02* (2006.01)
*H01J 43/18* (2006.01)
*H01J 49/00* (2006.01)

(52) U.S. Cl.
CPC ..... *H01J 49/025* (2013.01); *H01J 43/18* (2013.01); *H01J 49/0031* (2013.01); *H01J 49/0095* (2013.01)

(58) Field of Classification Search
CPC .. H01J 49/025; H01J 49/0031; H01J 49/0095; H01J 43/18
USPC ..... 250/281, 282, 283, 286, 287
See application file for complete search history.

(56) References Cited

U.S. PATENT DOCUMENTS 3,997,779 A 12/1976 Rabl
6,841,936 B2 1/2005 Keller et al.
7,047,144 B2 5/2006 Steiner
7,109,463 B2 9/2006 Milshtein et al.
7,745,781 B2 6/2010 Steiner
7,855,361 B2 12/2010 Steiner
8,637,811 B2 1/2014 Steiner et al.
9,269,552 B2 2/2016 Steiner et al.
9,355,828 B1 * 5/2016 Smith ..... H01J 49/0031
9,396,914 B2 7/2016 Steiner et al.
9,625,417 B2 4/2017 Steiner et al.
2007/0013898 A1 * 1/2007 Wolters ..... G01N 21/47 356/237.2
2011/0240857 A1 * 10/2011 Kovtoun ..... H01J 43/30 250/336.1
2015/0325420 A1 * 11/2015 Collings ..... H01J 49/025 250/282
2016/0172173 A1 * 6/2016 Schoen ..... H01J 49/025 250/282
2018/0012744 A1 * 1/2018 Collings ..... H01J 49/025

* cited by examiner

*Primary Examiner* — Nicole M Ippolito
(74) *Attorney, Agent, or Firm* — Benoit & Côté Inc.

(57) ABSTRACT

The invention relates to mass spectrometers having secondary electron multipliers with series of discrete dynode stages. The invention particularly relates to an operation with extended dynamic measuring range and extended lifetime. The invention is based on not adapting the dynamic measuring range by control of the gain of the trans-impedance amplifier, nor controlling the multiplier operating voltage, which both are usually too slow, but alternating a number of active and passive dynode stages of a discrete dynode multiplier. Each dynode stage is connected to a discrete voltage supply circuit, being able to be de-energized and short-cut; the multiplier gain is feedback-controlled by energizing or short-cutting dynode stages, serially from the end of the multiplier, as a function of a last measured ion signal; and the multiplier has a single trans-impedance amplifier and a single analog-to-digital converter, measuring and digitizing the output current of the last active dynode stage.

20 Claims, 4 Drawing Sheets

MASS SPECTROMETER HAVING MULTI-DYNODE MULTIPLIER(S) OF HIGH DYNAMIC RANGE OPERATION

BACKGROUND OF THE INVENTION

Field of the Invention

The invention relates to secondary electron multipliers with series of discrete dynode stages as used in some kind of mass spectrometers (MS), such as having 3-D and 2-D ion traps, quadrupole mass filters and, in particular, triple quadrupole assemblies as the mass analyzer. The invention particularly relates to an operation with extended dynamic measuring range and with extended lifetime.

Description of the Related Art

Discrete dynode detectors operate in high vacuum. As shown in the schematic of FIG. 1, in a secondary electron multiplier (SEM) design with a series of discrete dynodes, ions convert to electrons on the first dynode. For this purpose, it is biased at a fixed high voltage. Its polarity determines the ion polarity to be detected. Using the subsequent series of dynodes, each biased by a positive voltage, the electrons are accelerated into the next dynode, creating multiple secondary electrons. Usually, the dynode surfaces are critically conditioned to a low work function, to yield a high gain of secondary electrons. The secondary electron current is increased from dynode to dynode forming a kind of electron avalanche. The additional current at each dynode is delivered by the voltage supplied to the dynode.

At the last dynode, sometimes called the "anode", the output current can be measured. Typically, it is converted by a trans-impedance amplifier into an output voltage which then is read by an analog-to-digital-converter (ADC) into the digital storage of an acquisition system. Typical SEMs have a gain of around $10^6$ and operate at about 2.5 kilovolts. The trans-impedance amplifier typically is set to another gain of $10^6$, creating a 1 Volt output for every $1\times10^{-6}$ Ampere input. This corresponds to a $1\times10^{-12}$ Ampere SEM input current at full scale 1V output. Since the noise floor of the amplifier output can be as low as $1\times10^{-4}$ Volts, signals on the SEM input of as low as $1\times10^{-16}$ Amperes or 100 attoamperes (equivalent to about 600 ions per second) can be measured. This is good enough to detect single ion events in measuring rates up to 1 megasample per second.

Assuming the ADC saturates at 1 Volt, and having a noise threshold of $1\times10^{-4}$ Volts, a dynamic range of the overall acquisition system of $10^4$ for a single measuring sample results, typically not enough for analytical needs. If data are collected at 100 kilosamples per second and the signal is summed over 100 milliseconds, the dynamic range can be extended to $10^8$. This time is not always available, for example in common gas or liquid chromatography applications. Since this dynamic measuring range can be limiting to the analytical procedure, systems have been implemented to extend the dynamic range using various gain switching techniques.

There are multipliers with 11 to 22 dynode stages. In a multiplier with 22 dynode stages, the dynode surfaces must be less critically conditioned and show much less aging. Sometimes a thoroughly cleaned surface of a suitable metal is sufficient. Multipliers age by operation, since the electron bombardment of the conditioned surface changes the surface conditions, especially in a vacuum with some organic compounds in the residual gas resulting in organic layer deposits on the surfaces; a resulting higher work function lowers the gain of secondary electrons. Each multiplier has its lifetime. If the amplification becomes too weak, the multiplier has to be replaced.

One technique to enhance the dynamic measuring range is to change the trans-impedance amplifier gain, which has the limitation of saturation of the SEM output current. The SEM output current becomes saturated when the strong electron output current is no longer fully supported by the voltage supply to the dynode.

Other techniques, like extending the dynamic range in triple quadrupole mass spectrometers according to U.S. Pat. No. 7,047,144 (U. Steiner; "Ion Detection in Mass Spectrometry with Extended Dynamic Range") include changing the SEM gain based on the ion signal of the previous scan reading. This is still limited in speed by the slew rate of the SEM high voltage power supply.

U.S. Pat. No. 9,625,417 (U. Steiner; "Ion Detectors and Methods Using them") solves all these limitations, by measuring every dynode current in parallel, extending the dynamic range to $10^{15}$. Unfortunately, this implementation is costly and involves complicated circuitry. There is also a large host of further related disclosures originating, among others, from Urs Steiner, such as U.S. Pat. No. 9,269,552 ("Ion detectors and methods of using them"), U.S. Pat. No. 9,396,914 ("Optical detectors and methods of using them"), U.S. Pat. No. 8,637,811 ("Stabilized electron multiplier anode"), U.S. Pat. No. 7,855,361 ("Detection of positive and negative ions"), and U.S. Pat. No. 7,745,781 ("Real-time control of ion detection with extended dynamic range").

The U.S. Pat. No. 3,997,779 (C.-R. Rabl; "Circuit device for secondary electron multipliers"), U.S. Pat. No. 6,841,936 (C. A. Keller et al.; "Fast recovery electron multiplier"), and U.S. Pat. No. 7,109,463 (E. Milshtein et al.; "Amplifier circuit with a switching device to provide a wide dynamic output range") present various discrete dynode multipliers for photo- and charged particle detection.

In view of the foregoing, there is a need for multi-dynode multipliers that do not show, or show to a much lesser extent, the aforementioned shortcomings and disadvantages. Other objectives to be achieved will readily suggest themselves to those of skill in the art upon reading the following disclosure.

SUMMARY OF THE INVENTION

Using pulse switching electronics, a very simple and cost-effective solution is now proposed to produce a very large dynamic range and fast signal response. In a first aspect, the dynamic range of an ion detector system is increased to greater than $10^{15}$. According to another aspect, the gain control is ultra-fast, in the low nanoseconds, so real-time operation is possible, in particular for quadrupole or trap-based mass spectrometers. In a further aspect, the lifetime of the detector is increased; detector aging is slowed by stopping the secondary electron flow to lower dynodes at high ion currents. Still another aspect concerns robust electronics and lower cost of the system. The SEM high voltage does not require fast changes. The detector system is adaptable into a dual polarity detector with simultaneous detection of positive and negative ions, because there is no requirement to switch high voltages. The switching time of ion polarity is now only limited by the switching of the mass analyzer voltages, and not by the ion detector.

Generally, the invention is based on the idea not to adapt the dynamic measuring range by control of the gain of the trans-impedance amplifier, nor by control of the multiplier operating voltage, which both are too slow, but to selectively activate and short-cut dynode stages of a discrete dynode multiplier, which are driven by substantially non-variable operating voltages when active.

The disclosure relates to a mass spectrometer having a secondary electron multiplier for multiplying ion current-triggered secondary electron currents in a series of discrete dynode stages, such as featuring between about eleven and about twenty-two dynode stages, comprising: (i) a voltage supply circuit for each dynode stage, each being configured to supply a substantially non-variable voltage to the corresponding dynode stage when active; (ii) a feedback control circuit, which has no DC path to ground, dividing the series of discrete dynode stages into a first subrange of active dynode stages and a second subsequent subrange of passive dynode stages, where the first and second subranges together make up the total series of discrete dynode stages, thereby being able to change a multiplier gain as a function of a number of active dynode stages in the first subrange and as a function of a last measured ion signal; and (iii) a single trans-impedance amplifier and a single analog-to-digital converter, measuring a secondary electron output current of a last active dynode stage in the first subrange.

In various embodiments, the first subrange of active dynode stages (with operating voltage ramped up) can operate with secondary electron multiplication and the second subrange of passive dynode stages can be characterized by de-energization and short-cutting a line from one dynode stage to the next (using appropriate fast-responding short-cut switches).

In various embodiments, each voltage supply circuit can establish a substantially non-variable voltage difference in relation to a preceding active dynode stage, such as about 100 Volts difference. The energy source for a voltage supply circuit can be a voltage regulator using a first dynode current, a controllable battery, or any other suitable source of energy, as the case may be having associated electronic circuitry for being able to ramp up and down the operating voltage, depending on the state of the dynode stage as being active or passive, respectively. The voltage difference can be the same or may vary between the different active dynode stages, such as being 100 Volts each along the active dynode stages or monotonically rising or decreasing, thereby providing for varying gain factors along the active discrete dynode stages.

In various embodiments, a calibration process may measure the gain of each dynode stage. By summing all the gains of the active dynode stages, and the ADC reading, the number of ion current inputs can be back computed.

In various embodiments, a minimal SEM gain can be required. In such cases, a certain number of upstream dynode stages may always be active, eliminating the need for on/off switches and corresponding controls.

In various embodiments, a first dynode stage to convert ions to electrons can be at a substantially non-variable voltage potential, such as in the kilovolts range, appropriately selected for a mass range to be measured. Preferably, a polarity of the substantially non-variable voltage potential is appropriately selected for an ion polarity to be measured, that is, positive or negative high voltage for being attractive to negative and positive ions, respectively. The multiplier entrance may be driven, for instance, with constant −5 kilovolts high voltage supply of only 0.5 Watt to supply a 100 microamperes chain current. This enables a constant ion-to-electron conversion rate, regardless of the number of active and passive dynode stages in the first and second subranges, respectively, while switching only the electron gain.

In various embodiments, the multiplier operation can further comprise powering the voltage supply circuits of the series of discrete dynode stages using a predetermined (substantially non-variable) electric current, such as about 100 microamperes, along the chain of voltage supply circuits.

In various embodiments, some or all of the voltage supply circuits can be de-energized and short-cut (using appropriate fast-responding switches), using feedback control by a data output of the analog-to-digital converter. Instead of making all dynode stages present switchable between active and passive mode, it is possible to configure a certain number of upstream dynode stages such that they are permanently active, for example the first eleven dynode stages in a series of twenty-two total dynode stages. In any case, a variable series of short-cuts, characterizing the passive dynode stages in the second subrange, may guide the secondary electron output current of the last active dynode stage in the first subrange (a "temporary" anode) to the trans-impedance amplifier. The operating voltage of each passive dynode stage is ramped down in order to avoid overloading the input of the trans-impedance amplifier.

In various embodiments, the multiplier can further comprise a program in an operating system of the mass spectrometer which repeatedly measures the gain of the different dynode stages to monitor aging during ongoing operation of the multiplier. Preferably, the program further encompasses providing initially for not using the terminal dynode stages of a fresh multiplier, such as stage numbers 20, 21 and 22 in a series of twenty-two in total, while keeping them as reserve dynode stages to compensate a multiplier gain lowered by aging during ongoing operation of the multiplier.

In various embodiments, the dynode stages may be mounted on the inner surfaces of two oppositely arranged printed circuit boards which carry, on the outside, electronic elements of the voltage supply circuits. Preferably, the printed circuit boards are made of plastic, glass or ceramic material.

In various embodiments, the mass spectrometer may further comprise a two-dimensional ion trap, three-dimensional ion trap, single quadrupole mass filter, or triple quadrupole assembly as a mass analyzer.

In various embodiments, the feedback control circuit can be ground potential-based or floating at a level of the analog-to-digital converter where dynode short-cut on/off switches and operating voltages are controlled by appropriate DC controls.

In various embodiments, the feedback control circuit may be adjusted to switch one or more dynode stages per reading of the analog-to-digital converter between the first subrange (active) and the second subrange (passive) for changing the gain.

In various embodiments, the mass spectrometer can have two secondary electron multipliers for multiplying ion current-triggered secondary electron currents in two series of discrete dynode stages (of identical configuration as the case may be), wherein the respective first dynode stages in the two series of discrete dynode stages are kept at substantially non-variable voltages of opposite polarity, such as in the kilovolts range, thereby enabling the simultaneous detection of positive and negative ions without high voltage switching.

In alternative embodiments, the multiplier may further comprise changing a voltage polarity at a first dynode stage of the series of discrete dynode stages during operation in order to alternate between positive ion detection and negative ion detection.

The disclosure relates further to a method for multiplying ion current-triggered secondary electron currents in a series of discrete dynode stages in a mass spectrometer, comprising: (i) dividing the series of discrete dynode stages into a first subrange of active dynode stages and a second subsequent subrange of passive dynode stages, where the first and second subranges together make up the total series of discrete dynode stages, thereby setting a predetermined multiplier gain as a function of a number of active dynode stages in the first subrange; (ii) supplying each active dynode stage in the first subrange with a substantially non-variable voltage; (iii) measuring a secondary electron output current of a last active dynode stage in the first subrange, triggered by an incoming ion current; and, (iv) if the measured secondary electron output current indicates a multiplier gain issue, such as signal overshoot/saturation due to excessively high ion currents or gain deterioration due to aging, adjusting the division of the series of dynode stages into the first subrange and the second subrange for avoiding or resolving the multiplier gain issue.

In various embodiments, each active dynode stage in the first subrange may be supplied such that a same substantially non-variable number of secondary electrons results for each impinging charged particle, such as an ion for the very first dynode stage in the series or a secondary electron generated in a preceding dynode stage.

BRIEF DESCRIPTION OF THE DRAWINGS

The invention can be better understood by referring to the following figures. The components in the figures are not necessarily to scale, emphasis instead being placed upon illustrating the principles of the invention (often schematically). In the figures, like reference numerals may designate corresponding parts throughout the different views.

DETAILED DESCRIPTION

While the invention has been shown and described with reference to a number of different embodiments thereof, it will be recognized by those of skill in the art that various changes in form and detail may be made herein without departing from the scope of the invention as defined by the appended claims.

Figure 2:
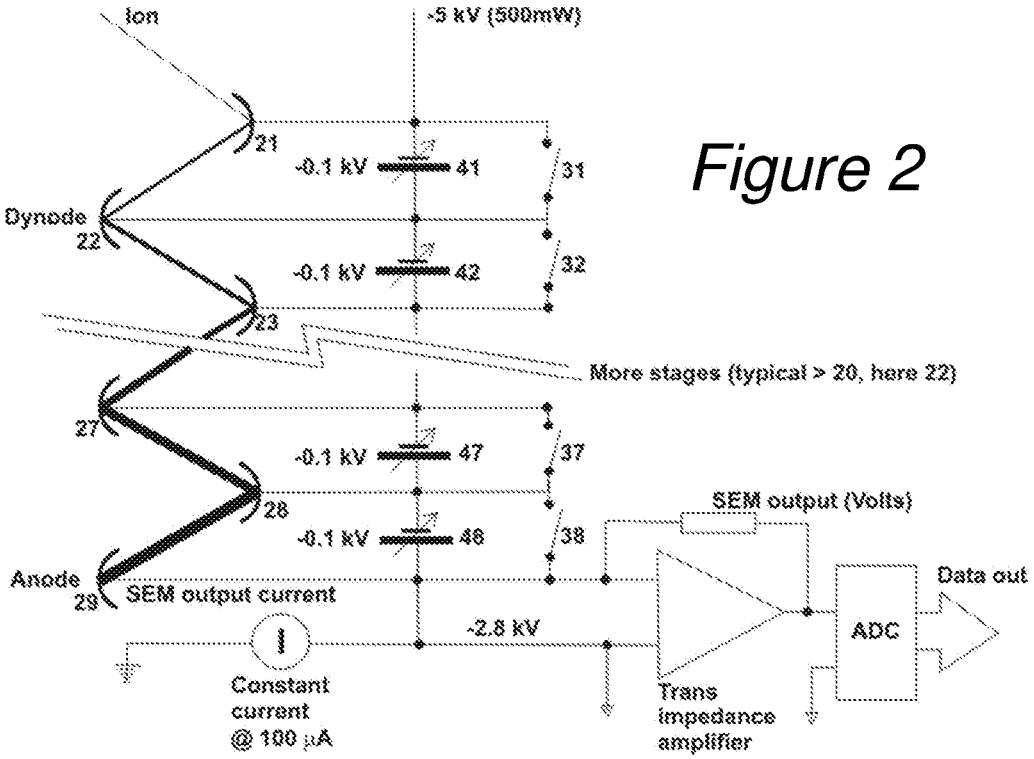
FIG. 2 illustrates the high gain operation of a multiplier according to principles of the invention (all dynode stages active, energized and assigned to the first subrange).
Figure 3:
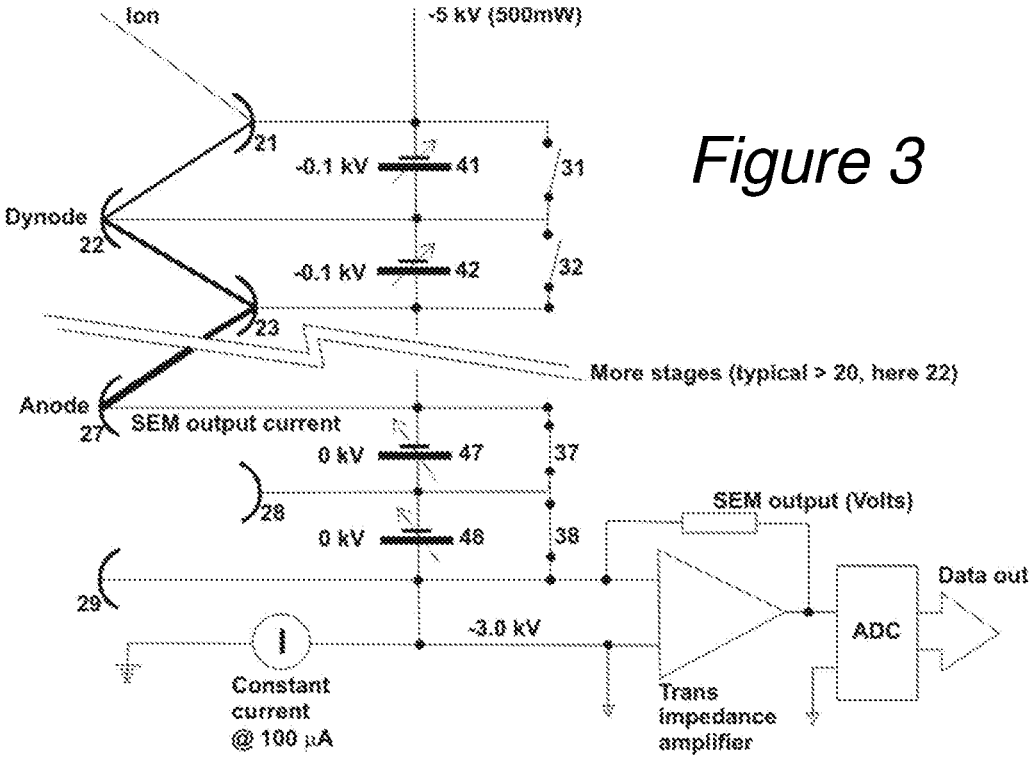
FIG. 3 shows the lower gain operation of the multiplier with two short-cut (or passive) dynode stages at the end.

The principle of the invention will be described mainly with reference to the embodiment presented in FIGS. 2 and 3, showing schematically discrete multiplier dynodes (21) to (29), discrete voltage supply circuits (41) to (48), and discrete short-cut switches (31) to (38). For simplification, the voltage supply circuits (41) to (48) are drawn symbolically as controllable batteries, though using other sources of energy is conceivable. A more detailed depiction of the circuitry is also shown by way of example in FIG. 4.

The voltage values in the drawings may correspond to a multiplier with 22 dynode stages, but this number of stages is not reflected by the reference numerals for the stages for the sake of simplicity and clarity. Generally, there are multipliers with 11 to 22 dynode stages. To yield an amplification of $10^6$, a multiplier with 11 dynodes has to deliver 3.53 secondary electrons per impinging electron on each of the dynodes, a multiplier with 17 dynodes has to deliver 2.17 secondary electrons per electron, and a multiplier with 22 dynodes needs only to deliver about 2 secondary electrons per electron. In a multiplier with 22 dynode stages, the dynode surfaces must be less critically conditioned and show much less aging. Sometimes a thoroughly cleaned surface of a suitable metal is sufficient.

FIG. 2 presents the multiplier in a high gain mode, supplying voltages (e.g. 100 Volts each) to each pair of dynodes up to the end dynode (29) of the multiplier. All short-cut switches (31) to (38) are shown open which means that all dynodes (21) to (29) are energized, active and belong to the first subrange in the series of discrete dynode stages. The multiplier output current from the last active dynode (29), here called the anode, is amplified and converted into a voltage by the trans-impedance amplifier. The output of this amplifier is digitized by an analog-to-digital converter (ADC).

FIG. 3 depicts the multiplier in a lower gain mode. In this example, the last two short-cut switches (37) and (38) are closed, and the voltages supplied to the last two dynodes (28) and (29) are ramped down in order to prevent overloading the entrance of the trans-impedance amplifier. In other words, the last two dynodes (28) and (29) constitute a second subrange of passive dynode stages while the remaining upstream dynode stages (21) to (27) make up a first subrange of active dynode stages. The multiplier output current of dynode (27), now called the (temporary) anode, is guided via the switches (37) and (38) to the trans-impedance amplifier, amplified, and digitized. There is no secondary electron bombardment of the passive dynodes (28) and (29) in this example, thus conserving the dynode surfaces from aging. The amplification of the SEM can be further reduced by short-cutting more upstream dynode stages if necessary (and increased again by opening the switches as the case may be).

The trans-impedance amplifier and the ADC are on floating potentials in the example shown; the data output has to be transformed from this floating potential to ground.

As can be seen from FIGS. 2 and 3, the invention comprises a discrete dynode secondary electron multiplier with generally the following features:

(a) each dynode stage is driven with a discrete voltage supply circuit at a substantially constant (non-variable) voltage when active;

(b) the multiplier gain is feedback controlled by de-energizing and short-cutting dynode stages, serially or in multiples from the end of the multiplier, as a function of a last measured ion signal;

(c) the multiplier has a single trans-impedance amplifier and a single analog-to-digital converter, measuring and digitizing the secondary electron output current of the last active dynode.

The feedback control can be ground potential-based as shown in the example, or could also be floating at the ADC level, where the dynode short-cut on/off switches and operating voltages are controlled by appropriate DC controls. The number of ions detected can be computed by summing each active dynode stage gain stage and the measured ADC value. This result then needs to be isolated and transmitted to the MS controls.

In this example, the line of dynode supply circuits is driven with non-variable current of about 100 microamperes. Each dynode stage is allowed to be de-energized and short-cut, feedback-controlled by the acquisition system. The short-cut switches guide the output current of the last active dynode to the trans-impedance amplifier.

Usually, the dynode surfaces are critically conditioned to a low work function, to yield a high gain of secondary electrons. In the embodiment of FIGS. 2 and 3, a multiplier with 22 dynode stages is used, reducing the requirement for a high gain of secondary electrons per dynode. A gain of two secondary electrons per impinging electron is sufficient, but this gain should be kept intact during aging.

Figure 4:
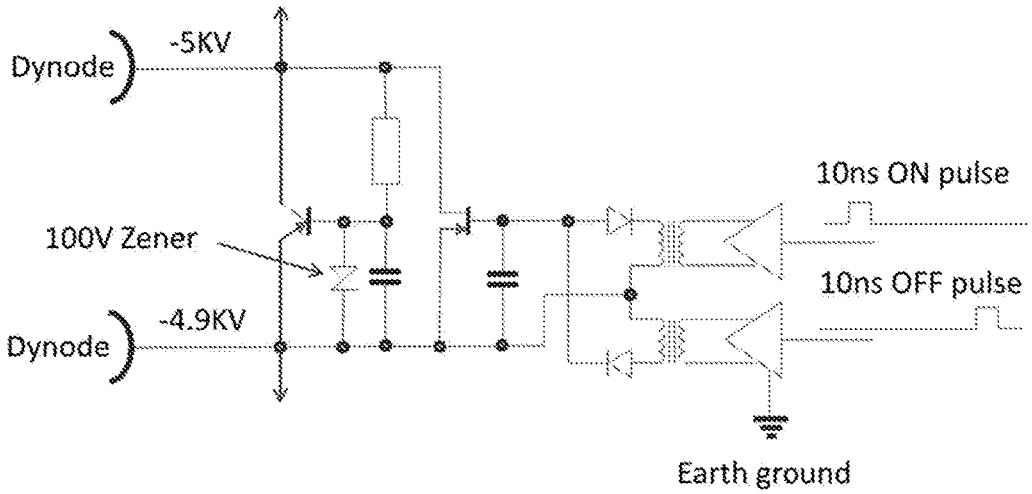
FIG. 4 presents an example for the electric circuitry of the power supply and switch for one of the dynode stages where the control is ground potential-based.

FIG. 4 depicts an example for an electric circuit to supply the operating voltage of a set of neighboring dynode stages and a field-effect transistor (FET) short-cutting this operating voltage without having a DC current path to ground. On- or off-pulses, e.g., about 10 nanoseconds long, close and open the short-cut line allowing this stage to be active or passive. The pulses may be delivered from a suitable pulse generator, feedback-controlled by the ion current-triggered measurement data.

Figure 5:
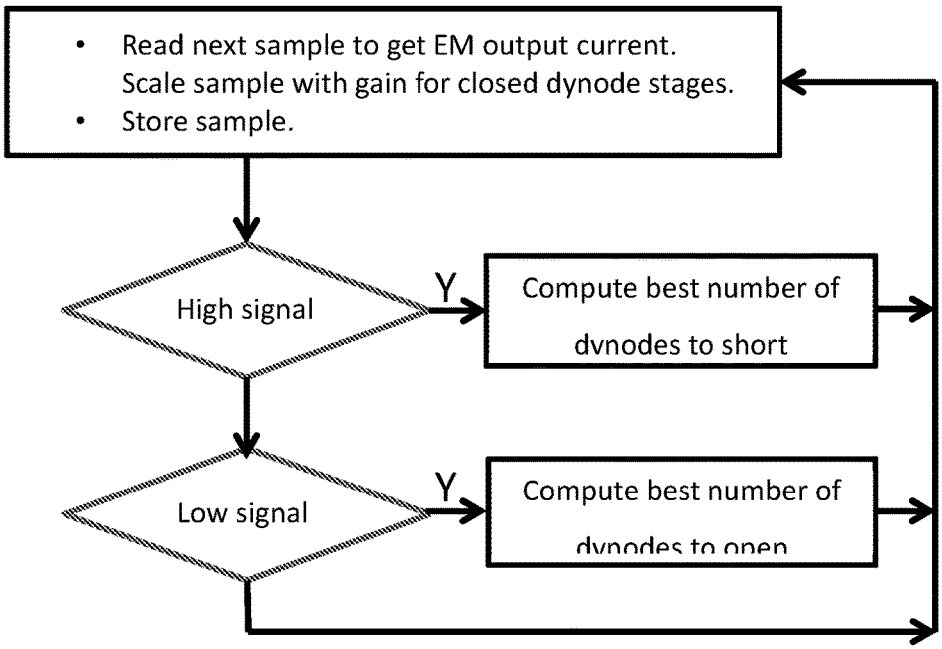
FIG. 5 shows a flow diagram for the operation of a multiplier.

FIG. 5 presents a typical flow diagram for this feedback control. The dynamic range of the ADC reading is much larger than one dynode stage gain. The feedback gain can therefore be adjusted to switch one or more dynode short-cut switches (to make them active or passive). This allows tracking of fast input current changes, without saturating the trans-impedance amplifier. This may prove beneficial for single ion monitoring (SIM) and multiple reaction monitoring (MRM) applications.

The SEM presented has a gain of around $10^6$ and operates at 2.2 kilovolts voltage difference in high gain mode. The trans-impedance amplifier is set to another gain of $10^6$, creating a 1 Volt output for every $1\times10^{-6}$ Ampere input. This corresponds to a $1\times10^{-12}$ Ampere SEM input current at full scale 1 Volt output. Since the noise floor of the amplifier output can be as low as $1\times10^{-4}$ Volts, signals on the SEM input of as low as $1\times10^{-16}$ Ampere (100 attoamperes; equivalent to about 600 singly charged ions per second) can be measured. This is good enough to detect single ion events in measuring rates of up to 1 megasamples per second.

The invention is based on the idea of adapting the dynamic measuring range by adapting the multiplier gain using a varying number of active/energized and passive/de-energized/short-cut dynode stages, instead of adapting the amplification of the trans-impedance amplifier. The multiplier gain is thus lowered by a reduction of the number of active dynode stages in the first subrange of the total series of dynode stages.

Multipliers suffer from aging. The electron bombardment on the dynode surfaces, particularly on the last dynodes, changes the surface conditioning. Molecules of layers on the surfaces may be cross-linked by the bombardment, increasing the work function and lowering the gain of secondary electrons. In usual operation, the aging of the multiplier is compensated by a steady increase of the operating voltage, thereby raising the gain of secondary electrons to its previous value. Since the multiplier according to principles of the present invention, as shown in FIGS. 2, 3 and 4, operates at a substantially non-variable or fixed operating voltage at the active dynode stages, the aging process cannot be compensated for by an increase of the operating voltage. It is, therefore, favorable to use a multiplier arrangement which initially shows a total amplification of much more than the normal operation gain, such as between $10^5$ and $10^6$. If a multiplier with 22 dynodes is used, and each dynode delivers 2.1 secondary electrons per primary electron, a fresh multiplier has a gain of $1.2\times10^7$ if all dynodes are energized and activated. To achieve a wanted gain of about $10^6$, for instance, a fresh multiplier can be used with only 19 dynodes activated, the last three dynodes being passive. If the multiplier ages, this can be compensated for by using 20, 21 and finally 22 dynodes. This type of operation is adaptable to multipliers having a large range of dynode stage numbers and is additionally beneficial in that the last dynodes stay fresh until being used.

The multiplier according to principles of the invention reduces dynode aging because the dynodes are gently treated during operation. The dynodes are rarely oversaturated. This mild operation can be emphasized by special procedures. For example, if the mass spectrometer jumps to a new mass to be measured, oversaturation can be avoided by first measuring with low amplification (only a few dynodes active), and increasing the number of active dynode stages in subsequent measurements until a favorable amplification is reached.

During the use of such a multiplier, the dynodes do not age uniformly, because of the irregular use of the dynodes. Having a regulated, non-variable (constant) voltage between active dynodes will help keep the dynode-to-dynode gain constant. But as mentioned before, the work function of the surface may age over time, so it will therefore be necessary to re-compute each dynode stage gain from time to time (typically on a monthly basis). For this procedure, a program in the spectrometer's operating system installed on a computer can measure and store each stage gain by dividing the signal read with the corresponding dynode stage while active and while passive, while a stable ion signal of appropriate strength is input to the multiplier. This may typically be performed in less than 20 microseconds. To precompute the gain of all 22 dynodes this would be just a few milliseconds. Detector gain calibration can be a fast, robust, invisible routine, done often and regularly if needed. Summing the gain of all active dynode stages, and the ADC signal, the ions entering the detector can be back computed. By using the ADC conversion rate, the output to ions/second detected can be scaled accordingly. This allows MS systems to provide absolute intensities. In some cases, it can eliminate the need for analytical response curves.

Figure 1:
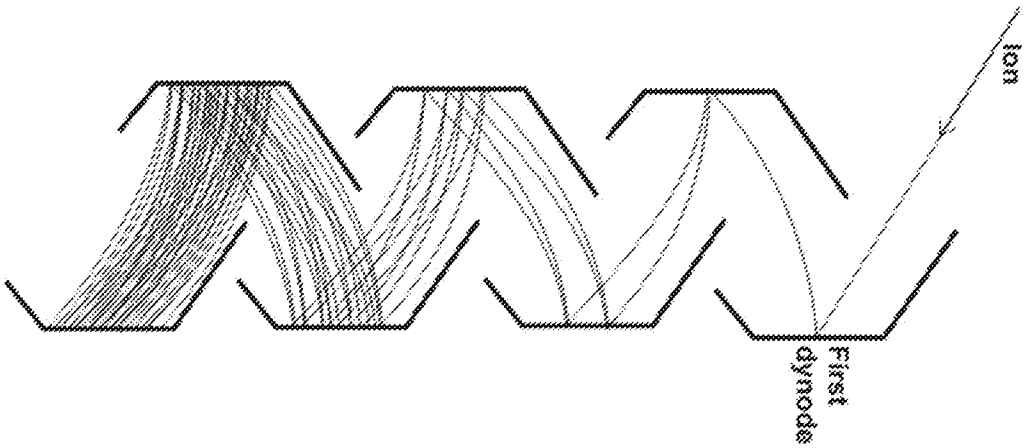
Figure 1 (Prior Art)
FIG. 1 presents a most basic example of a discrete dynode secondary electron multiplier with its avalanche of secondary electrons.
Figure 6:
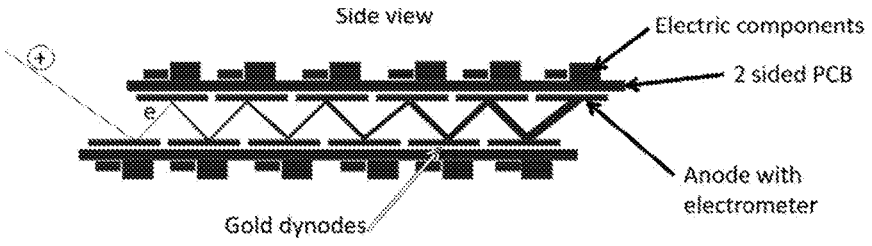
FIG. 6 depicts an example of a multiplier with plane dynode stages at the internal sides of two printed circuit boards (PCB) which carry the necessary electronics on their outer sides.

Multipliers with discrete dynodes must not be formed as shown in FIG. 1 but can take other forms. FIG. 6 depicts, by way of example, a multiplier where plane dynode stages are fastened on the inner surfaces of two oppositely arranged printed circuit boards (PCBs). The printed circuit boards may carry the electric components for the voltage supply circuits on the outside. Usual PCB plastics materials may be used; however, the quality of the vacuum may be improved by using glass or ceramic material for the PCB.

Figure 7:
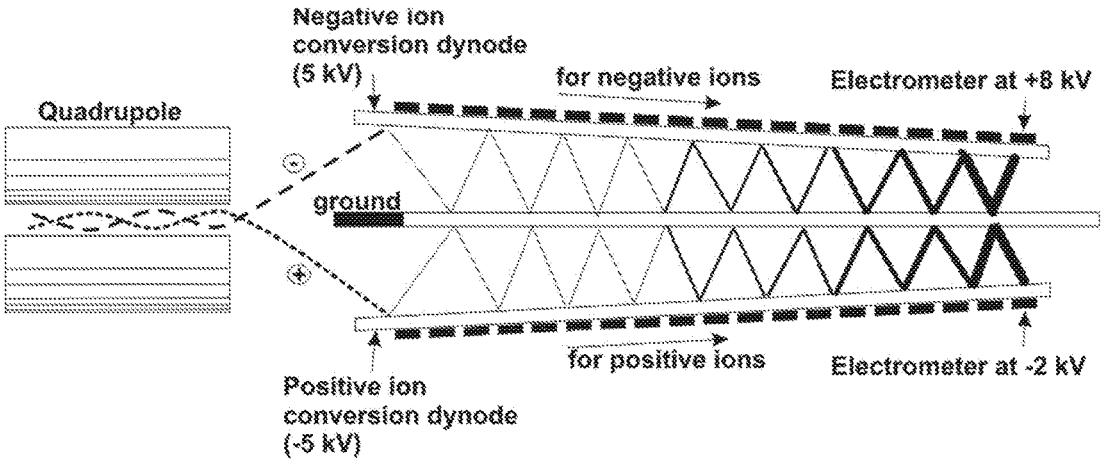
FIG. 7 illustrates schematically a twin SEM system for the simultaneous detection of positive and negative ions without the need for high voltage switching.

The multiplier with plane dynodes offers the possibility to build a twin SEM system for the simultaneous detection of positive and negative ions without the need for high voltage switching, as depicted by way of example in FIG. 7. Sequential positive and negative ions can be detected by alternating the polarity of the high voltage on the very first dynode stage of the series. This traditional operation remains an option.

The multipliers according to principles of the invention are well-suited for quadrupole ion traps, two-dimensional or three-dimensional, and for quadrupole filter mass spectrometers, particularly triple quadrupole mass spectrometers.

Using principles of the present disclosure, the high voltage power supply can be minimized, since only a fifth of the power of a conventional SEM power supply is typically used. This can be an important advantage in mobile MS applications.

The invention has been illustrated and described with reference to a number of different embodiments thereof. It will be understood by those of skill in the art that various aspects or details of the invention may be changed, or that different aspects disclosed in conjunction with different embodiments of the invention may be readily combined if practicable, without departing from the scope of the invention. Furthermore, the foregoing description is for the purpose of illustration only, and not for the purpose of limiting the invention, which is defined solely by the appended claims and will include any technical equivalents, as the case may be.

The invention claimed is:

1. A mass spectrometer having a secondary electron multiplier for multiplying ion current-triggered secondary electron currents in a series of discrete dynode stages, comprising:

a voltage supply circuit for each dynode stage, each being configured to supply a substantially non-variable voltage to the corresponding dynode stage when active;

a feedback control circuit, which has no DC path to ground, dividing the series of discrete dynode stages into a first subrange of active dynode stages and a second subsequent subrange of passive dynode stages, where the first and second subranges together make up the total series of discrete dynode stages, thereby being able to change a multiplier gain as a function of a number of active dynode stages in the first subrange and as a function of a last measured ion signal; and a single trans-impedance amplifier and a single analog-to-digital converter, measuring a secondary electron output current of a last active dynode stage in the first subrange.

2. The mass spectrometer according to claim 1, wherein the first subrange of active dynode stages operates with secondary electron multiplication and the second subrange of passive dynode stages is characterized by de-energization and short-cutting a line from one dynode stage to the next.

3. The mass spectrometer according to claim 1, wherein each voltage supply circuit establishes a substantially non-variable voltage difference in relation to a preceding active dynode stage.

4. The mass spectrometer according to claim 1, wherein a first dynode stage to convert ions to electrons is at a substantially non-variable voltage potential appropriately selected for a mass range to be measured.

5. The mass spectrometer according to claim 4, wherein a polarity of the substantially non-variable voltage potential is appropriately selected for an ion polarity to be measured.

6. The mass spectrometer according to claim 1, further comprising powering the voltage supply circuits of the series of discrete dynode stages using a predetermined electric current along the chain of voltage supply circuits.

7. The mass spectrometer according to claim 1, wherein some or all of the voltage supply circuits can be de-energized and short-cut, feedback controlled by a data output of the analog-to-digital converter.

8. The mass spectrometer according to claim 7, wherein a variable series of short-cuts guides the secondary electron output current of the last active dynode stage in the first subrange to the trans-impedance amplifier.

9. The mass spectrometer according to claim 1, further comprising a program in an operating system of the mass spectrometer which repeatedly measures the gain of the different dynode stages to monitor aging during ongoing operation of the multiplier.

10. The mass spectrometer according to claim 9, wherein the program further encompasses providing initially for not using the terminal dynode stages of a fresh multiplier, while keeping them as reserve dynode stages to compensate a multiplier gain lowered by aging during ongoing operation of the multiplier.

11. The mass spectrometer according to claim 1, wherein the dynode stages are mounted on the inner surfaces of two oppositely arranged printed circuit boards which carry, on the outside, electronic elements of the voltage supply circuits.

12. The mass spectrometer according to claim 11, wherein the printed circuit boards are made of plastic, glass or ceramic material.

13. The mass spectrometer according to claim 1, wherein the series of discrete dynode stages comprises between about eleven and about twenty-two dynode stages.

14. The mass spectrometer according to claim 1, further comprising a two-dimensional ion trap, three-dimensional ion trap, single quadrupole mass filter, or triple quadrupole assembly as mass analyzer.

15. The mass spectrometer according to claim 1, wherein the feedback control circuit is ground potential-based or floating at a level of the analog-to-digital converter where dynode short-cut on/off switches and operating voltages are controlled by appropriate DC controls.

16. The mass spectrometer according to claim 1, wherein the feedback control circuit is adjusted to switch one or more dynode stages per reading of the analog-to-digital converter between the first subrange (active) and the second subrange (passive) for changing the gain.

17. The mass spectrometer according to claim 1, having two secondary electron multipliers for multiplying ion current-triggered secondary electron currents in two series of discrete dynode stages, wherein the respective first dynode stages in the two series of discrete dynode stages are kept at substantially non-variable voltages of opposite polarity, thereby enabling the simultaneous detection of positive and negative ions without high voltage switching.

18. The mass spectrometer according to claim 1, further comprising changing a voltage polarity at a first dynode stage of the series of discrete dynode stages during operation of the multiplier in order to alternate between positive ion detection and negative ion detection.

19. A method for multiplying ion current-triggered secondary electron currents in a series of discrete dynode stages in a mass spectrometer, comprising:

dividing the series of discrete dynode stages into a first subrange of active dynode stages and a second subsequent subrange of passive dynode stages, where the first and second subranges together make up the total series of discrete dynode stages, thereby setting a pre-determined multiplier gain as a function of a number of active dynode stages in the first subrange;

supplying each active dynode stage in the first subrange with a substantially non-variable voltage;

measuring a secondary electron output current of a last active dynode stage in the first subrange, triggered by an incoming ion current; and, if the measured secondary electron output current indicates a multiplier gain issue, adjusting the division of the series of dynode stages into the first subrange and the second subrange for avoiding or resolving the multiplier gain issue.

20. The method according to claim 19, wherein each active dynode stage in the first subrange is supplied such that a same substantially non-variable number of secondary electrons results for each impinging charged particle.

* * * * *